US005309796A

United States Patent [19]

Jones

[11] Patent Number: 5,309,796

[45] Date of Patent: May 10, 1994

[54] RATCHET WRENCH

[76] Inventor: George B. Jones, Rte. 15, Box 125 C, Fayetteville, N.C. 28306

[21] Appl. No.: 55,876

[22] Filed: May 4, 1993

[51] Int. Cl.[5] ..... B25B 13/46

[52] U.S. Cl. ..... 81/57.39; 81/57.46; 81/63.1

[58] Field of Search ..... 81/57.39, 57.46, 58.1, 81/60, 63.1

[56] References Cited

U.S. PATENT DOCUMENTS

| | | | |
|---|---|---|---|
| 2,633,044 | 3/1953 | Pasquariello . | |
| 2,723,580 | 11/1955 | Brame . | |
| 2,726,563 | 12/1955 | Blackburn . | |
| 3,557,644 | 1/1971 | Gregory . | |
| 3,616,714 | 11/1971 | Gregory . | |
| 3,726,161 | 4/1973 | Williams et al. . | |
| 3,867,855 | 2/1975 | Siebert | 81/63.1 |
| 3,941,017 | 3/1976 | Lenker et al. . | |
| 4,031,785 | 6/1977 | Wheeler | 81/57.39 |
| 4,108,027 | 8/1978 | Lenker . | |
| 4,304,157 | 12/1981 | Yamada et al. . | |
| 4,425,828 | 1/1984 | Berdinner | 81/57.39 |

*Primary Examiner*—James G. Smith

*Attorney, Agent, or Firm*—Robert G. Rosenthal

[57] ABSTRACT

A ratchet wrench comprising a housing defining a chamber, a drive mechanism, a pawl arm, and a handle. The drive mechanism is adapted to mount a wrench member and is positioned proximate the distal end of the housing. The drive mechanism is adapted to mount a wrench member and is positioned proximate the distal end of the housing. The drive mechanism includes a ratchet first wheel having a first set of ratchet teeth oriented in a first direction and a second ratchet wheel having a second set of ratchet teeth oriented in a direction opposite that of the first set of ratchet teeth. A handle is connected to the housing for pivotal movement and is spaced apart from the drive mechanism. A pawl arm is mounted for reciprocating movement between the handle and the drive mechanisms such that one end is in operative association with the handle and the opposite end includes a first pawl for driving the first ratchet wheel in a first direction and a second pawl for driving the second ratchet wheel in the opposite direction. Upon movement of the handle, the pawl arm moves so that at least one of the pawls moves into contacting relation with the corresponding ratchet teeth to rotate the drive mechanism.

8 Claims, 3 Drawing Sheets

RATCHET WRENCH

FIELD OF THE INVENTION

This invention relates generally to the field of hand tools and more particularly to a ratchet wrench for use in spaces where it is not possible to swing the wrench handle to rotate the wrench.

BACKGROUND OF THE INVENTION

Ratchet wrenches are well known and have been widely adopted. The typical ratchet wrench comprises a handle with one end to be gripped by the user and the opposite end mounting the socket. The socket is inserted over the head of a nut or bolt which is advanced by moving the handle through an arc of rotation. When working in small spaces, it is not always possible to rotate the wrench handle in the manner required to turn the nut, bolt, etc.

It is, therefore, an object of the present invention to provide a ratchet wrench that provides all of the features of a conventional ratchet wrench, but that operates without requiring rotation of the handle.

Another object of the present invention is to provide a ratchet wrench that is inexpensive.

A further object of the present invention is to provide a ratchet wrench that is reliable.

A still further object of the present invention is to provide a ratchet wrench that is relatively simple to manufacture.

SUMMARY OF THE INVENTION

To accomplish the objects described above, there is provided a ratchet wrench comprising a housing defining a chamber having a proximal end and a distal end. A drive means adapted to mount a wrench member is positioned proximate the distal end of the housing. The drive means includes a ratchet wheel means having a first set of ratchet teeth oriented in a first direction and a second set of ratchet teeth oriented in a direction opposite that of the first set of ratchet teeth. A handle is connected to the housing and is spaced apart from the drive means. A pawl arm has a first end and a second end and is positioned between the drive means and the handle. The pawl arm is mounted for reciprocating movement between the handle and the drive means. The pawl arm is positioned such that the first end is in operative association with the handle and the second end has a first pawl pointing in a first direction adapted to contact the first set of ratchet teeth and a second set of ratchet teeth adapted to contact the second set of ratchet teeth. Upon movement of the handle, the pawl arm moves so that at least one of the pawls moves into contacting relation with the corresponding ratchet teeth to rotate the drive means.

BRIEF DESCRIPTION OF THE DRAWINGS

Some of the features and advantages of the Invention having been briefly been stated, others will appear from the detailed description which follows, when taken in connection with the accompanying drawings, in which—

DETAILED DESCRIPTION OF THE ILLUSTRATED EMBODIMENT

Figure 1:
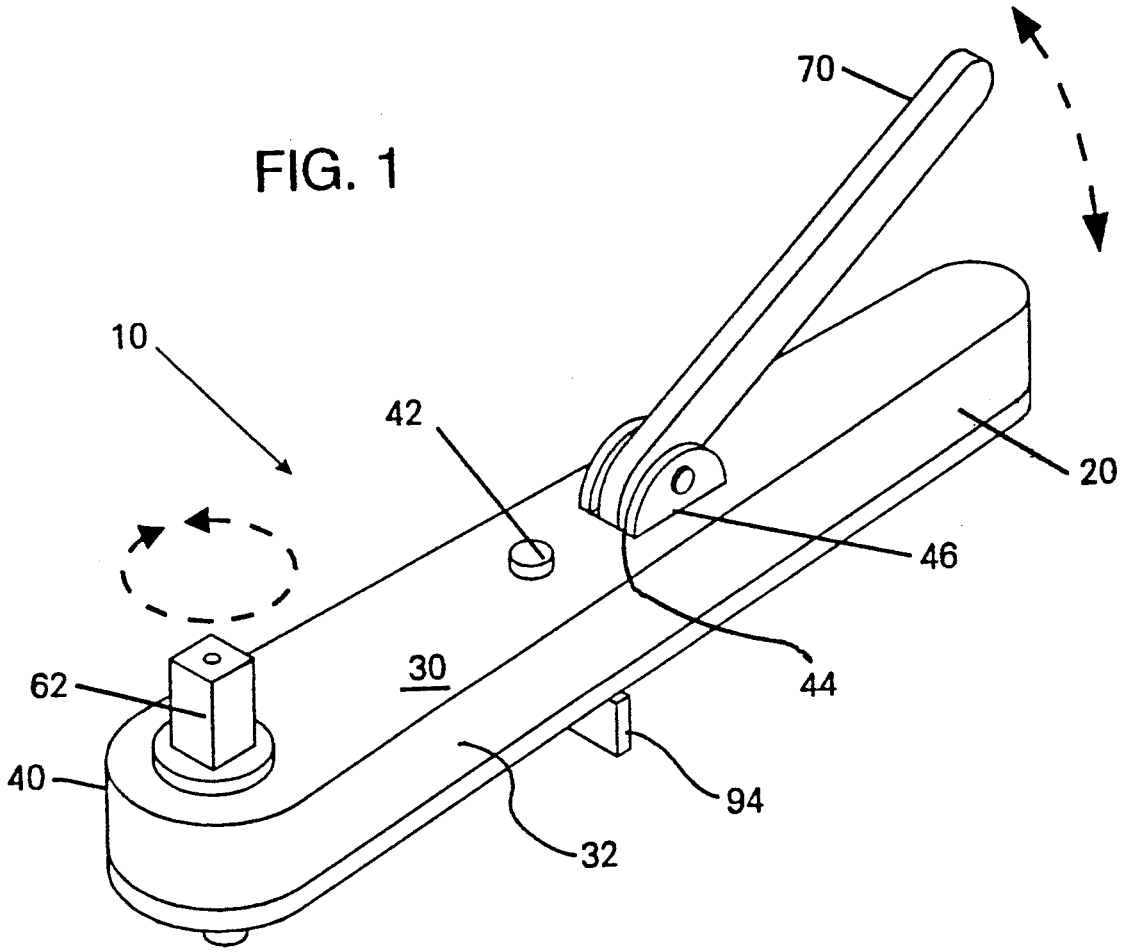
FIG. 1 is a perspective view of the ratchet wrench according to the present invention.
Figure 2:
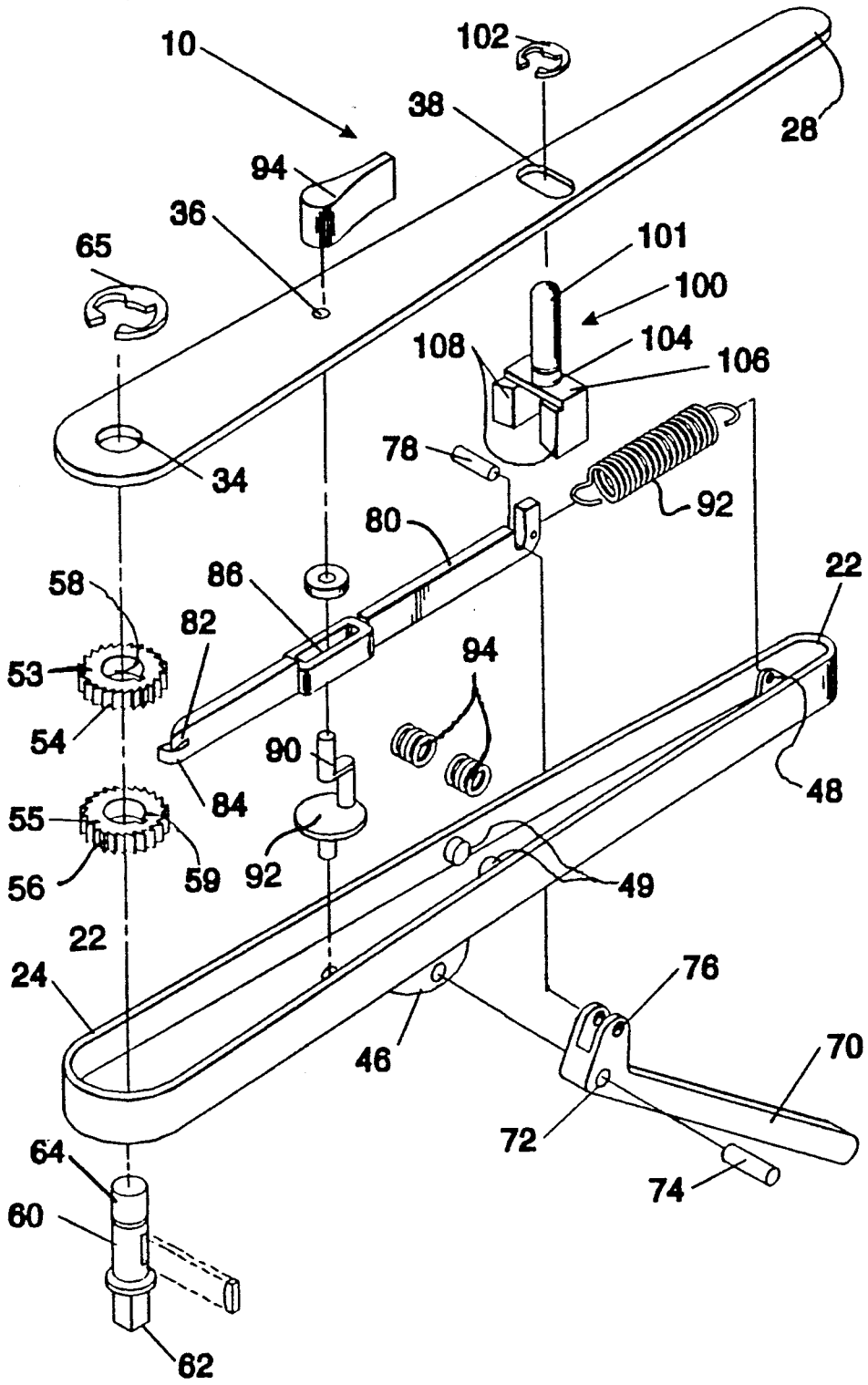
FIG. 2 is an exploded view of the ratchet wrench according to the present invention.

While the present invention will be described more fully hereinafter, it is to be understood at the outset that persons of skill in the art may modify the invention herein described while still achieving the favorable results of this invention. Accordingly, the description which follows is to be understood as being a broad teaching disclosure directed to persons of skill in the appropriate arts, and not as limiting upon the present invention.

Referring now to the drawings, the ratchet wrench generally indicated at 10 comprises a housing 20, a drive means 50, a handle 70, and pawl arm 80.

The elongate housing 20 defines a chamber 22 and has a proximal end 24 and a distal end 26. The housing 20 includes a flat top cover 28 and a bottom 30 having raised side walls 32 along the periphery thereof. The housing 20 is fabricated from metal, preferably steel and is of sufficient strength so as to be structural for the intended application. The top of the housing 20 has three holes defining openings 34,36,38.

Similarly, the bottom 30 includes three holes defining openings, 40,42,44 the purpose of which will become apparent as the description proceeds. Located medially on the underside of the housing 20 is a pivot structure 46 which mounts a handle 70 to be described hereinbelow. Also, within the chamber 22 near the proximal end 24 is a spring mounting block 48. A pair of inwardly pointing cylindrical protuberances 49 are located medially within the housing 20.

A drive means generally indicated at 50 is adapted to mount a wrench member (not shown) is positioned proximate the distal end 26 of the housing. The drive means 50 includes a ratchet wheel means 52 having a first set of ratchet teeth 54 oriented in a first direction and a second set of ratchet teeth 56 oriented in the direction opposite from the first set of ratchet teeth. The ratchet wheel means comprises a first ratchet wheel 53 and a second ratchet wheel 55 having oppositely oriented ratchet teeth. In addition, each wheel includes a centrally located bore 58 with a key slot therein. An elongate shaft 60 has a shank 62 at one of its ends and an annulus 64 proximate the opposite end. The shaft 60 is mounted for rotation and extends perpendicular to the longitudinal axis of the housing 20 such that the shank 62 extends downwardly beneath the housing, the central portion extends through the housing and the annulus 64 extends above the top cover 28 so that when a lock washer 65 is inserted therearound, the shaft 60 is fixed for rotation.

A handle 70 is pivotally connected to the housing 20 and is spaced apart from the drive means 50. The handle 70 is fabricated from metal, such as steel and is L-shaped. A pivot point 72 is located at the juncture of the long and short segments and the handle is mounted for pivotal movement with pin 74 about pivot structure 46 on the underside of the housing 20. Located at the opposite end of the short segment is a second pivot point 76.

A pawl arm 80 having a first end and a second end is positioned longitudinally within the housing 20 between the shaft 60 and the handle 70 and is mounted for reciprocating movement therebetween. The first end of the pawl arm 80 is connected to the handle via a pin connection 76 with pin 78. The second end of the pawl arm has a first pawl 82 pointing in a first direction adapted to contact the first set of ratchet teeth 54 and a second pawl 84 adapted to contact the second set of ratchet teeth 56. Located in the central portion of the pawl arm is a bulging segment 86 which is hollowed out to define an elliptical area 88 as shown which cooperates with a switching handle 90 to be described that operates to control the direction of rotation of the ratchet wheels 53,55. A coil spring 92 has one end connected to the spring mount 48 and the opposite end is connected to a connecting hole in the distal end of the pawl arm 80. A pair of tension springs 94 mounted on protuberances 49 straddle the pawl arm 80 on both sides thereof.

A switching handle 90 is inserted for rotation in openings 36 and 42 such that the lower end and flange 92 rest on the bottom of housing. A bent section extends through the elliptical opening 88 in pawl arm 80, through opening 36 in the top and to which a switching handle 84 is connected by suitable means such as an Allen nut (not shown).

Also provided is a means for using the wrench as a conventional socket wrench wherein the shank 62 does not rotate. A locking means, generally indicated at 100 includes a handle 101 is provided which extends through opening 38 and which is located in place when lock washer 102 is inserted in annulus 104. The opposite end of the handle 100 is connected to a flat plate 106. A pair of blocks 108 are mounted on both sides of the plate 106 such that the pawl arm 80 can move therebetween. The pawl arm may be locked in the forward position by sliding the locking unit 100 behind the arm 80 when in the maximum forward position (contacting with the ratchet wheels).

Figure 3:
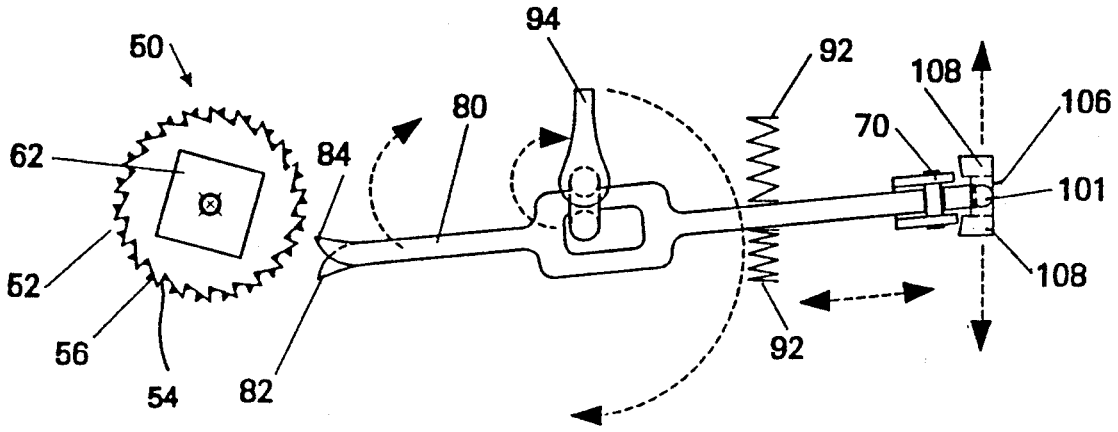
FIG. 3 is a plan view of the drive means showing the pawl arm in a first position for rotating the first ratchet wheel in a first direction.
Figure 4:
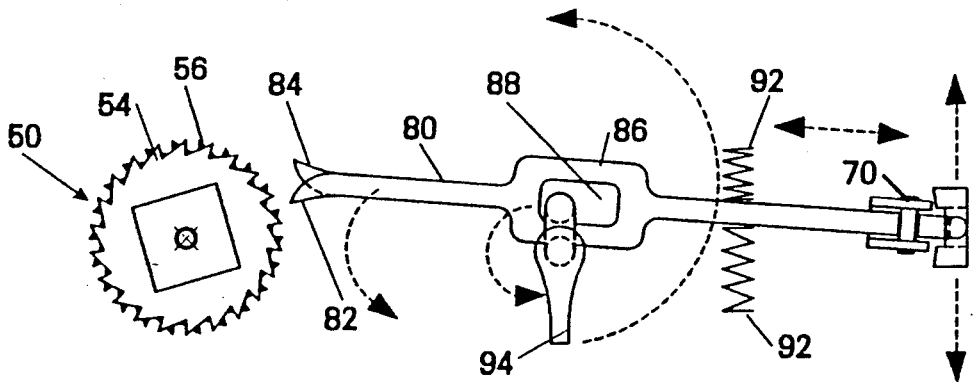
FIG. 4 is a plan view of the drive means showing the pawl arm in a second position for rotating the second ratchet wheel in the direction opposite from that of the first ratchet wheel.

As previously mentioned, ratchet wrench 10 may be operated so that the shank rotates clockwise or counterclockwise. When the decision as to the desired direction is made, the switching handle 90 is moved to the left or right side of the housing 20 (see FIG. 3 or 4). This causes the pawl arm 80 to be correspondingly off-center and to point towards one or the other of the ratchet wheels 53,55. Once the desired direction is selected, upon movement of the handle 70, towards the housing, the pawl arm 80 is driven forward so that the selected pawl 82 (or 84) contacts the corresponding teeth of one of the ratchet wheels 53 (or 55) causing rotation thereof. Conversely, when the handle 70 is released, the tension spring 94 pulls the pawl arm 80 back to the at-rest position where it is ready for the next compression of the handle.

In addition, the ratchet wrench may be used as a conventional wrench wherein the shank does not rotate. This is accomplished by positioning the locking handle 101 in alignment with the longitudinal axis of the housing so that the pawl arm 80 is positioned in the center of the housing 20. The handle 70 is then completely compressed driving the pawl arm 80 forward so that both pawls 82,84 contact the corresponding set of ratchet teeth 54,56. The locking plate 106 is then moved behind the end of the pawl arm 80 so that one of the blocks 108 contacts the end which effectively locks the pawl arm in the position of maximum extension. When it is desired to release the pawl arm 80 for normal ratchet operation, the handle 70 is slightly compressed and the locking handle 101 is moved to the neutral position where the pawl arm reciprocates between the blocks 108.

The foregoing embodiments and examples are to be considered illustrative, rather than restrictive of the invention, and those modifications which come within the meaning and range of equivalence of the claims are to be included therein.

That which is claimed is:

1. A ratchet wrench comprising:

an elongate housing defining a chamber having a proximal end and a distal end;

a drive means adapted to mount a wrench member positioned proximate the distal end of said housing, said drive means including a ratchet wheel means having a first set of ratchet teeth oriented in a first direction and a second set of ratchet teeth ratchet teeth oriented in a direction opposite that of the first set of ratchet teeth;

a handle connected to said housing and being spaced apart from said drive means;

a pawl arm having a first end and a second end, said pawl arm being positioned between said drive means and said handle and being mounted for reciprocating movement therebetween, and wherein the first end of said pawl arm is in operative association with said handle and the second end of said pawl arm has a first pawl pointing in a first direction adapted to contact the first set of ratchet teeth, and a second pawl adapted to contact the second set of ratchet teeth;

whereby upon movement of the handle, the pawl arm moves so that at least one of the pawls moves into contacting relation with the corresponding ratchet teeth to rotate the drive means.

2. The ratchet wrench according to claim 1 wherein said drive means includes a shaft and further, wherein said ratchet wheel means comprises a first ratchet wheel having a first set of ratchet teeth oriented in a first direction mounted on said shaft for rotating the shaft in the first direction and a second ratchet wheel having a second set of ratchet teeth oriented oppositely from said first set of ratchet teeth mounted on said shaft and overlying the first ratchet wheel for rotating the shaft in the opposite direction.

3. The ratchet wrench according to claim 2 wherein said handle comprises an elongate L-shaped body having a long member and a shorter member, and wherein the confluence therebetween is pivotally connected to said housing, the long member adapted to be gripped by the user and the shorter member being connected to the first end of said pawl arm.

4. The ratchet wrench according to claim 3 further including a spring means f or moving the pawl arm out of contact with the drive means.

5. The ratchet wrench according to claim 4 wherein said spring means comprises a spring having one end connected to said housing and the opposite end connected to the first end of said pawl arm.

6. The ratchet wrench according to claim 1 further including means for selecting which of the pawls contacts the corresponding set of ratchet teeth upon movement of the handle means.

7. The ratchet wrench according to claim 1 further including a locking means for locking the pawl arm so that the pawls contact the corresponding ratchet teeth.

8. A ratchet wrench comprising:

an elongate housing defining a chamber having a proximal end and a distal end;

a drive means adapted to mount a wrench member positioned proximate the distal end of said housing, said drive means comprising:

a rotatably mounted shaft extending perpendicular to the longitudinal axis of said housing and having a shank at one of its ends;

a first ratchet wheel having a first set of ratchet teeth oriented in a first direction mounted on said shaft;

a second ratchet wheel having a second set of ratchet teeth oriented in the direction opposite from the first set of ratchet teeth mounted on said shaft;

a handle pivotally connected to said housing and being spaced apart from said drive means;

a pawl arm having a first end and a second end, said pawl arm being positioned longitudinally within said housing between said shaft and said handle, and further being mounted for reciprocating movement therebetween, and wherein the first end of said pawl arm is connected to said handle and the second end of said pawl arm has a first pawl pointing in a first direction adapted to contact the first set of ratchet teeth and a second pawl adapted to contact the second set of ratchet teeth;

whereby upon movement of the handle, the pawl arm moves so that at least one of the pawls moves into contacting relation with the corresponding ratchet teeth to rotate the drive means.

* * * * *